United States Patent [19]

Wang

[11] Patent Number: 4,925,040

[45] Date of Patent: May 15, 1990

[54] CANTEEN

[76] Inventor: Paul S. Wang, 22428 Steeple Chase La., Diamond Bar, Calif. 91705

[21] Appl. No.: 362,102

[22] Filed: Jun. 6, 1989

[51] Int. Cl.[5] ..... B65B 47/06

[52] U.S. Cl. ..... 215/1 A; 222/514; 222/538; 222/464; 220/90.2

[58] Field of Search ..... 206/217, 218, 216, 541; 222/509, 514, 538, 464; 215/1 A; 220/90.2, 90.4

[56] References Cited

U.S. PATENT DOCUMENTS

| | | | |
|---|---|---|---|
| 1,103,674 | 7/1944 | Karp | 222/514 |
| 4,153,170 | 5/1979 | Aquarian | 215/1 A X |
| 4,228,913 | 10/1980 | Mack et al. | 215/1 A X |
| 4,660,748 | 4/1987 | Hagan | 222/509 |
| 4,684,032 | 8/1987 | Tsay | 215/1 A |

FOREIGN PATENT DOCUMENTS

| | | | |
|---|---|---|---|
| 1364352 | 5/1964 | France | 222/509 |
| 383010 | 11/1932 | United Kingdom | 222/514 |

*Primary Examiner*—Paul T. Sewell
*Assistant Examiner*—Jacob K. Ackun, Jr.

[57] ABSTRACT

A child's canteen having a latched pivotally mounted cap on its top which when closed engages a spring-loaded tubular member which extends into the interior of the canteen. The cap normally holds the tubular member in a retracted position. However, when the latched cap is released, the tubular member pops up through the top of the canteen and causes the cap to swing open. The contents of the canteen may now be sucked through the tubular member.

3 Claims, 4 Drawing Sheets

CANTEEN

BACKGROUND OF THE INVENTION

The invention is concerned with a children's canteen which may conveniently be carried on camping trips, picnics, games and the like; and which may be filled, for example, with water, lemonade, or other drinks or liquids.

SUMMARY OF THE INVENTION

The canteen of the invention has a latched cap which when closed extends over a spring-loaded tubular drinking straw assembly. When the cap is closed, the drinking straw assembly is pressed down into a retracted position in the top of the canteen. However, when the latch is released, the straw assembly pops up and causes the cap to swing open. The contents of the canteen may now be sucked through the straw.

DETAILED DESCRIPTION OF THE ILLUSTRATED EMBODIMENT

The canteen shown in FIGS. 1–6 includes a cylindrical shaped drink container 10 having a cover 12 threaded to its upper end. The canteen may conveniently be carried by a flexible shoulder strap 14 which is pivotally attached to the upper rim of container 10.

Figure 6:
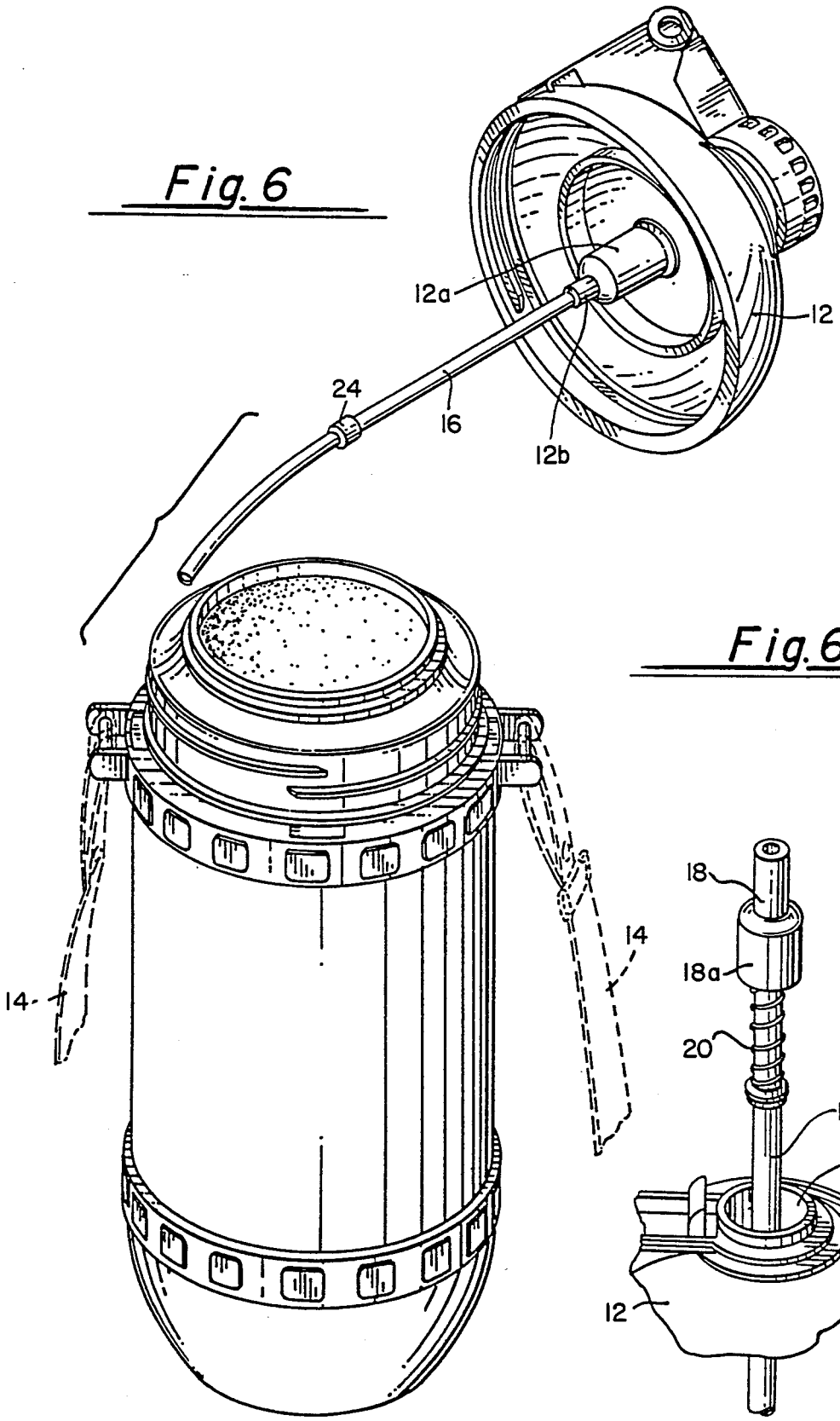
FIG. 6 is a detached perspective view showing the various components which make up the canteen.
Figure 6A:
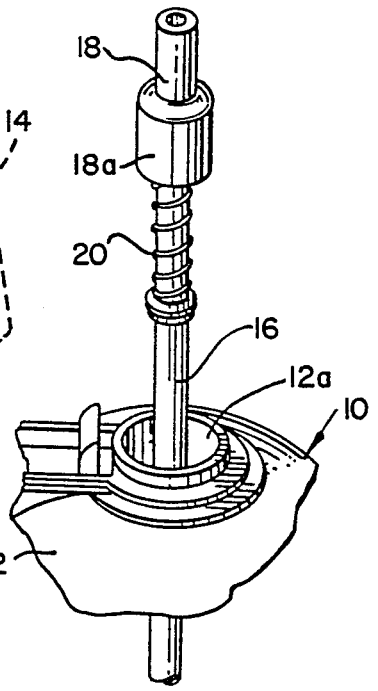
FIG. 6*a* is a fragmentary view showing certain internal components of the canteen projecting through the top of the canteen.

A resilient plastic straw 16 is contained in container 10, as best shown in FIG. 6, and a rigid nipple 18 which is mounted on the end of straw 16 extends through a bushing 12*a* formed integral with cover 12, so that the nipple may protrude out from the top of the cover. A coil spring 20 FIG. 6*a* is mounted coaxially with straw 16, and it normally is contained in the bushing 12*a*. The spring abuts a shoulder 18*a* formed by the nipple, and a shoulder within the bushing, so that it may exert a biasing force on the nipple and attached straw 16.

Figure 1:
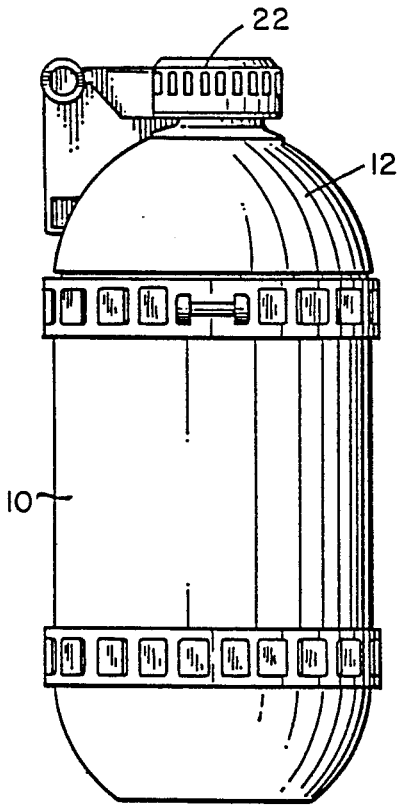
FIG. 1 is a side view of a canteen representing one embodiment of the invention with its cap in a closed position.
Figure 2:
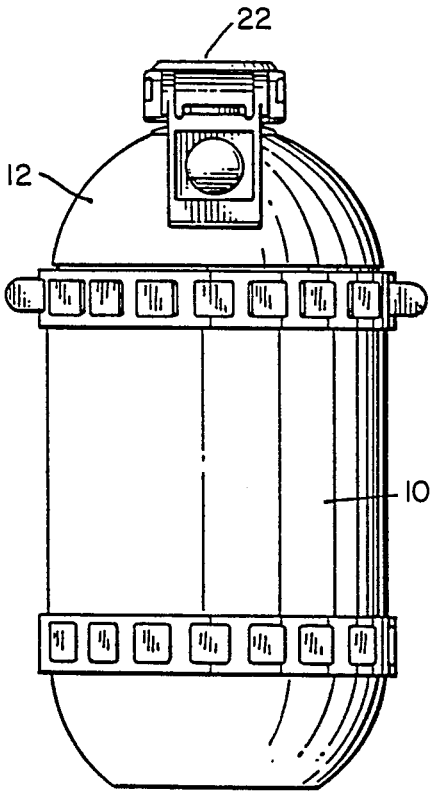
FIG. 2 is a view similar to FIG. 1 but with the canteen turned 90° on its longitudinal axis.
Figure 3:
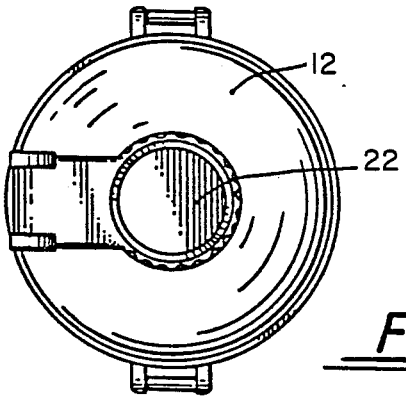
FIG. 3 is a top view of the canteen, likewise with its cap closed.
Figure 4:
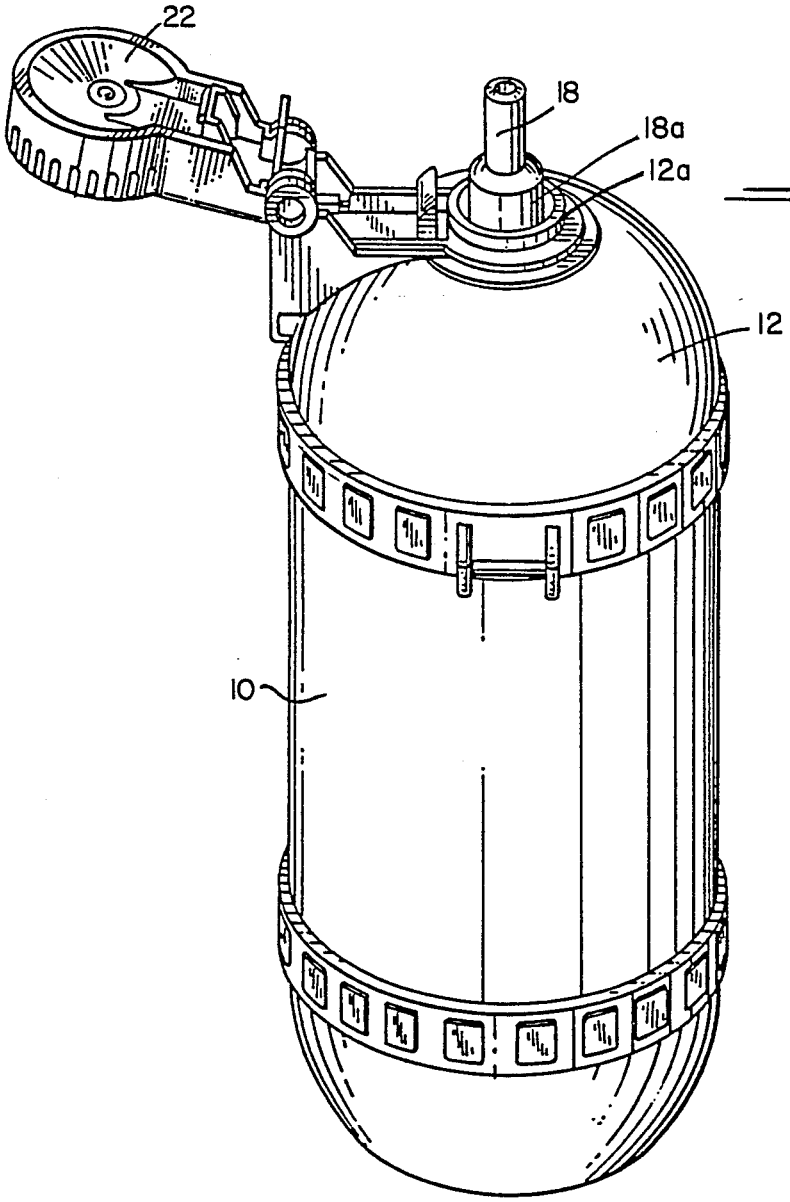
FIGS. 4 and 5 are perspective views taken from the top of the canteen and showing the cap in an open position.
Figure 5:
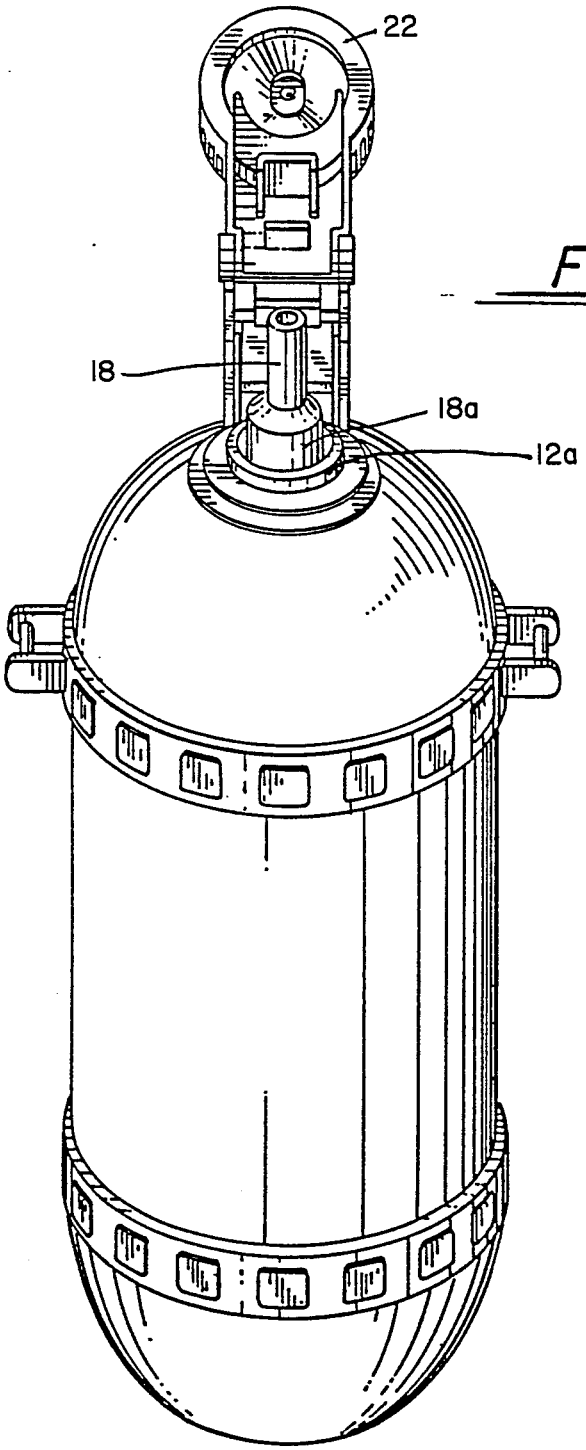

A cap 22 is pivotally mounted on cover 12, and when the cap is moved to a closed position, as shown in FIGS. 1–3, it forces nipple 18 down into the bushing 12*a*. However, when the cap is released, spring 20 causes the nipple to swing the cap to its open position shown in FIGS. 4 and 5, with the nipple protruding out from the top of the cover. The contents of the container may now be sucked through the straw. A sleeve 24 (FIG. 6) mounted coaxially on the straw limits the upward displacement of the nipple when the cap 22 is opened by engaging the end 12*b* of bushing 12*a* (FIG. 6).

A spring-biased latch 34 is slidably mounted on cover 12. The latch normally engages a lip on the underside of cap 22 when the cap is moved down to its closed position. However, when pushbutton 34*a* at the end of the latch is depressed, the lip is released, and the spring-biased nipple causes the cap to swing back to the open position of FIGS. 4 and 5. As mentioned above, the nipple now protrudes from the top of the cover, and the contents of the container may be sucked through the straw.

At any time, the cap may be returned to its closed and latched position, merely by moving it downwardly against the top of the nipple.

The invention provides, therefore, a simple and inexpensive canteen which is designed particularly for children. The canteen is constructed so that the user may drink the liquid in the canteen without the need for removing the cover.

While a particular embodiment of the invention has been shown and described, modifications may be made. It is intended in the claims to cover all modifications which come within the true spirit and scope of the invention.

I claim:

1. A canteen, or the like, including a liquid drink container having a top and a bushing formed in said top; spring-loaded tubular means extending through the bushing in the top of said container, said spring-loaded tubular means including a resilient tubular member and a rigid nipple mounted at the upper end of said resilient tubular member and received in said bushing, and said spring-loaded tubular means including a coil spring coaxially mounted on said tubular member and contained in said bushing, one end of said coil spring engaging a shoulder formed by the end of said nipple and the other end of said coil spring engaging a shoulder formed in said bushing; and a cap pivotally mounted on the top of said container and movable between a closed position in which it engages said tubular means and forces said tubular means down into the top of said container to a retracted position, and an open position in which it enables said tubular means to pop up to an extended position to enable liquid in said container to be removed through said tubular means.

2. A canteen defined in claim 1, and which includes spring-loaded latch means mounted on the top of said container for releasably holding said cap in its closed position.

3. The canteen defined in claim 1, and which includes a sleeve coaxially mounted on said tubular member to engage said bushing and limmit the upward displacement of said nipple through said top.

* * * * *